US008568852B2

(12) United States Patent
Smit et al.

(10) Patent No.: US 8,568,852 B2
(45) Date of Patent: Oct. 29, 2013

(54) ARTIFICIAL GRASS TURF AND INFILL FOR SPORTS FIELDS

(75) Inventors: Gerardus Hubertus Smit, Enschede (NL); Geurt Bastiaan Slootweg, Enschede (NL); Frederik Jan Van Der Gaag, Nuverdal (NL); Marinus Hendrikus Olde Weghuis, Oldenzaal (NL); Francois Antoine Marie Op Den Buijsch, Voerendaal (NL); Wilhelmus Gerardus Marie Bruls, Geulle (NL); Leonardus Jacobus Johannus Wilhelmus Welzen, Urmond (NL); Christian Antoine Marie Jean-Pierre Widdershoven, Echt (NL)

(73) Assignee: Ten Cate Thiolon B.V. (NL)

( * ) Notice: Subject to any disclaimer, the term of this patent is extended or adjusted under 35 U.S.C. 154(b) by 737 days.

(21) Appl. No.: 11/628,107

(22) PCT Filed: Jun. 14, 2005

(86) PCT No.: PCT/NL2005/000433
§ 371 (c)(1),
(2), (4) Date: Jan. 17, 2008

(87) PCT Pub. No.: WO2005/124028
PCT Pub. Date: Dec. 29, 2005

(65) Prior Publication Data

US 2008/0317978 A1 Dec. 25, 2008

(30) Foreign Application Priority Data

Jun. 17, 2004 (NL) ..... 1026444

(51) Int. Cl.
*E01C 13/08* (2006.01)
*B32B 5/16* (2006.01)
*B32B 5/30* (2006.01)

(52) U.S. Cl.
USPC ..... 428/87; 428/17; 428/402

(58) Field of Classification Search
USPC ..... 428/17, 87, 403, 402, 407
See application file for complete search history.

(56) References Cited

U.S. PATENT DOCUMENTS

| | | | |
|---|---|---|---|
| 3,549,724 | A | 12/1970 | Okazaki et al. |
| 3,565,742 | A | 2/1971 | Stephens et al. |
| 3,837,980 | A | 9/1974 | Nishimura et al. |
| 4,044,179 | A | 8/1977 | Haas, Jr. |

(Continued)

FOREIGN PATENT DOCUMENTS

| | | |
|---|---|---|
| EP | 0259940 | 3/1988 |
| EP | 0432272 | 6/1991 |

(Continued)

OTHER PUBLICATIONS

Machine translation of JP 07-324011A, Dec. 12, 1995.*

(Continued)

*Primary Examiner* — Cheryl Juska
(74) *Attorney, Agent, or Firm* — Olson & Cepuritis, Ltd.

(57) ABSTRACT

The present invention relates to an artificial turf suitable for sports fields including a substrate to which first artificial grass fibers are attached and a granular infill, which is provided between the first artificial grass fibers and which is made of a recyclable synthetic material. The invention also relates to an improved granular infill for use in an artificial turf suitable for sports fields.

11 Claims, 1 Drawing Sheet

(56) References Cited

U.S. PATENT DOCUMENTS

| | | | | |
|---|---|---|---|---|
| 4,176,150 | A | 11/1979 | Bromley et al. | |
| 4,337,283 | A | 6/1982 | Haas, Jr. | |
| 5,006,057 | A | 4/1991 | Bagrodia et al. | |
| 5,922,462 | A | 7/1999 | Kent et al. | |
| 5,958,527 | A * | 9/1999 | Prevost | 428/17 |
| 5,985,934 | A * | 11/1999 | Gaffney et al. | 514/672 |
| 6,528,556 | B1 * | 3/2003 | Herbst et al. | 523/122 |
| 6,815,059 | B2 | 11/2004 | Slootweg et al. | |
| 6,887,535 | B2 * | 5/2005 | Stroppiana | 428/17 |
| 6,955,841 | B2 | 10/2005 | Weghuis et al. | |
| 7,153,553 | B2 * | 12/2006 | Tetrault | 428/17 |
| 7,399,514 | B2 * | 7/2008 | De Clerck | 428/92 |
| 7,754,308 | B2 * | 7/2010 | Koch et al. | 428/87 |
| 8,173,209 | B2 * | 5/2012 | Chereau et al. | 427/212 |
| 2001/0033902 | A1 | 10/2001 | Seaton | |
| 2002/0146519 | A1 * | 10/2002 | Carr et al. | 428/17 |
| 2003/0099787 | A1 | 5/2003 | Fink | |
| 2003/0108688 | A1 | 6/2003 | De Vries | |
| 2003/0157275 | A1 | 8/2003 | Weghuis et al. | |
| 2004/0086664 | A1 * | 5/2004 | Seaton | 428/17 |
| 2004/0214000 | A1 * | 10/2004 | Huff et al. | 428/404 |
| 2005/0064112 | A1 | 3/2005 | Nicholls et al. | |
| 2005/0238823 | A1 | 10/2005 | Weghuis et al. | |
| 2006/0093783 | A1 * | 5/2006 | De Clerck | 428/92 |
| 2006/0100342 | A1 * | 5/2006 | Jensen | 524/492 |
| 2006/0172092 | A1 * | 8/2006 | Tetrault | 428/17 |
| 2007/0049694 | A1 * | 3/2007 | Koch et al. | 525/240 |
| 2007/0249788 | A1 * | 10/2007 | Buijsch Op Den et al. | 525/242 |
| 2008/0044599 | A1 * | 2/2008 | Stroppiana | 428/17 |
| 2008/0176009 | A1 * | 7/2008 | Chereau et al. | 428/17 |
| 2008/0182040 | A1 * | 7/2008 | Chereau et al. | 428/17 |
| 2008/0242794 | A1 * | 10/2008 | Sandford et al. | 524/515 |
| 2008/0292865 | A1 * | 11/2008 | Ball et al. | 428/317.1 |
| 2009/0011152 | A1 * | 1/2009 | Stroppiana | 428/17 |
| 2009/0172970 | A1 * | 7/2009 | Prieto et al. | 36/71 |
| 2009/0205157 | A1 * | 8/2009 | Allaway | 15/345 |
| 2009/0286017 | A1 * | 11/2009 | Horio et al. | 428/17 |
| 2009/0286018 | A1 * | 11/2009 | Horio et al. | 428/17 |
| 2009/0291147 | A1 * | 11/2009 | Sandford et al. | 424/618 |
| 2010/0040808 | A1 * | 2/2010 | Van Der Gaag et al. | 428/17 |
| 2010/0055461 | A1 * | 3/2010 | Daluise et al. | 428/403 |
| 2010/0093454 | A1 * | 4/2010 | Ball et al. | 472/92 |
| 2010/0151158 | A1 * | 6/2010 | Mashburn et al. | 428/17 |
| 2010/0173102 | A1 * | 7/2010 | Van Reijen | 428/17 |
| 2011/0081506 | A1 * | 4/2011 | Lee | 428/17 |
| 2011/0117297 | A1 * | 5/2011 | Harmeling | 428/17 |
| 2011/0135851 | A1 * | 6/2011 | Dozeman et al. | 428/17 |
| 2012/0183705 | A1 * | 7/2012 | Chereau et al. | 428/17 |
| 2012/0258811 | A1 * | 10/2012 | Tetrault et al. | 472/92 |
| 2012/0309858 | A1 * | 12/2012 | Taylor | 521/49 |
| 2013/0017023 | A1 * | 1/2013 | Nicholls et al. | 406/39 |

FOREIGN PATENT DOCUMENTS

| | | | |
|---|---|---|---|
| EP | 1158099 | | 11/2001 |
| EP | 1386944 | | 2/2004 |
| EP | 1389649 | | 2/2004 |
| EP | 1378592 | | 9/2004 |
| GB | 938768 | | 10/1963 |
| JP | 61257504 | A * | 11/1986 |
| JP | 62112803 | A * | 5/1987 |
| JP | 01127703 | A * | 5/1989 |
| JP | 06033412 | A * | 2/1994 |
| JP | 06157222 | A * | 6/1994 |
| JP | 07324011 | A * | 12/1995 |
| JP | 2000096510 | A * | 4/2000 |
| JP | 2011068582 | A * | 4/2011 |
| JP | 2012117305 | A * | 6/2012 |
| KR | 2010088590 | A * | 8/2010 |
| KR | 1033905 | B1 * | 5/2011 |
| KR | 2011131906 | A * | 12/2011 |
| WO | WO 02/00973 | | 1/2002 |
| WO | WO 0222960 | A1 * | 3/2002 |
| WO | WO 03/082965 | | 10/2003 |
| WO | WO 2004/041721 | | 5/2004 |
| WO | WO 2004/106601 | | 12/2004 |
| WO | WO 2005/005730 | | 1/2005 |
| WO | WO 2005/047602 | | 5/2005 |
| WO | WO 2006092337 | A1 * | 9/2006 |
| WO | WO 2006136436 | A1 * | 12/2006 |

OTHER PUBLICATIONS

English translation of JP 61-257504A, Nov. 1986.*

* cited by examiner

ARTIFICIAL GRASS TURF AND INFILL FOR SPORTS FIELDS

CROSS-REFERENCE TO RELATED APPLICATIONS

This application claims priority based on Netherlands Application No. 1026444 filed Jun. 17, 2004 and is the National Stage of International Application No. PCT/NL2005/000433 filed on Jun. 14, 2005, which are incorporated herein by reference.

FIELD OF THE INVENTION

The present invention relates to an artificial turf suitable for sports fields including a substrate to which first artificial grass fibers are attached and a granular infill, which is provided between the first artificial grass fibers and which is made of a recyclable synthetic material. The invention also relates to an improved granular infill for use in an artificial turf suitable for sports fields.

BACKGROUND OF THE INVENTION

An artificial grass sports field as generally referred to above is known, for example, see EP 1 158 099.

Many sports, such as field hockey, tennis, American football, etc. are now played on artificial grass sports fields, which fields are made up of an artificial turf as referred to above. Although athletes sustain fewer injuries on a natural grass sports field when falling or making a sliding tackle, on account of the softer surface thereof, such sports fields are often severely damaged when the above sports are played thereon, precisely because they are used intensively and because of the varying influence of the weather conditions.

Artificial grass sports fields, on the other hand, require less maintenance and can be played on much more intensively than natural grass sports fields. To provide artificial grass sports fields with playing characteristics that resemble those of natural grass as much as possible, a granular material such as sand or grains of a synthetic material is spread between the artificial grass fibers. These infilled grains not only provide a softer, shock-absorbing playing surface on which players are less prone to injury, but they also provide improved playing characteristics.

However, the use of an infill in an artificial grass sports field has a number of drawbacks. Not only is the construction of such an artificial grass sports field more labor-intensive than the construction of a natural grass sports field, but an artificial grass sports field provided with an infill requires subsequent maintenance as well. The initially uniform distribution of the granular infill can be disturbed by intensive usage. As a result, areas containing hardly any infill may form in places where the field is played on very intensively, for example in the goal area, which has an adverse effect on the quality of play, but which above all leads to an increased risk of injury. The distribution and the amount of the granular material of an artificial grass sports field provided with an infill must be verified at regular intervals and repairs must be carried out, if necessary.

Furthermore, it has become apparent that the weather influences the properties of the infill with the passage of time, which has a negative effect on the quality of the infill and thus on the playing characteristics of the artificial grass sports field. A negative factor, for example, is the strong compaction of the infill, as a result of which the artificial grass sports field will feel increasingly hard during play, with an increased risk of injury. Furthermore, the synthetic infill may change (harden or become brittle) under the influence of the weather conditions (sunlight, for example). Generally, the currently known artificial grass sports fields that make use of a granular infill are characterized by playing characteristics that deteriorate with the passage of time.

SUMMARY OF THE INVENTION

The present invention provides an artificial grass sports field that does not exhibit the above drawbacks. According to the invention, the artificial turf is characterized in that one or more additives have been added to the granular synthetic infill for improving the playing characteristics of the artificial turf.

In one aspect, the present invention provides an artificial turf wherein one or more additives have been added to a granular synthetic infill to improve the playing characteristics of the artificial turf.

In another aspect, the invention provides an improved granular infill for use in an artificial turf suitable for sports fields.

DETAILED DESCRIPTION OF PREFERRED EMBODIMENTS

Figure 1A:
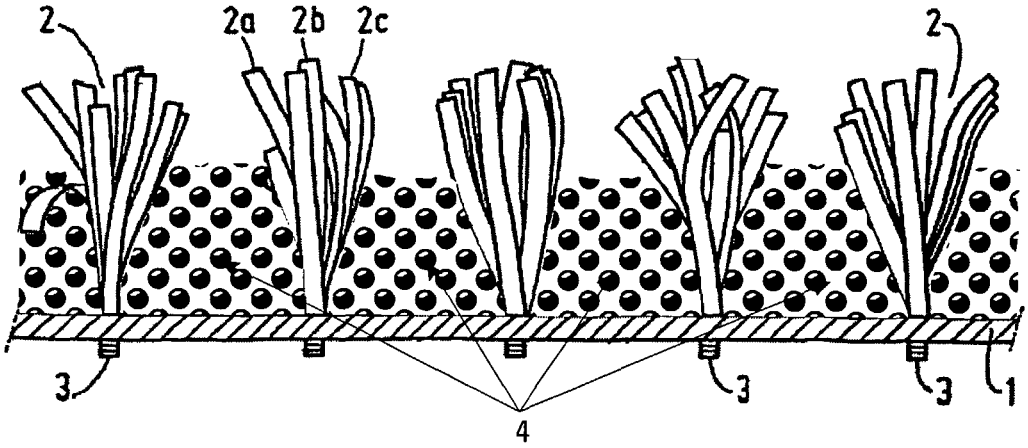
FIGS. 1*a* and 1*b* schematically show embodiments of an artificial grass sports field provided with a granular infill according to the invention.

The invention disclosed herein is, of course, susceptible to embodiment in many forms. Shown in the drawings and described herein in detail are preferred embodiments of the invention. It is understood, however, that the present disclosure is an exemplification of the principles of the invention and does not limit the invention to the illustrated embodiments.

The present invention provides an artificial turf that is characterized in that one or more additives have been added to a granular synthetic infill for improving the playing characteristics of the artificial turf.

In a specific embodiment, the additive is a flame retardant, in particular, aluminium trihydrate (ATH).

In another functional embodiment of the artificial grass sports field or of the granular infill, the additive according to the present invention is an antistatic additive. As a result, any static electricity generated during play can discharge. Usually, the known infill that is present between the fibers, which is used in many artificial grass sports fields, is statically charged during play, causing it to migrate upwards in the field. Thus, the granular infill can be spread through the air, which is less pleasant during play. The use of an antistatic additive eliminates these drawbacks.

The antistatic additive also ensures that no static discharges will take place via the players.

More specifically, the antistatic additive may be a polymer, especially a permanent antistatic agent, such as a polyamide or a polyether block amide. In another embodiment, the additive is a polyester block copolymer. In another embodiment, the additive is a polyester block copolymer, a glycerol ester, a synthetic amine or an alkyl sulphonate.

In another functional embodiment, the additive is a hydrophilic additive. The artificial grass sports field thus obtained has the function-specific characteristic that it is capable of absorbing moisture (water) via the granular infill. As a result, the artificial grass sports field in question will remain moist longer, which has a positive effect on the way the players play (making sliding tackles, etc). When the field is played on, the absorbed moisture is released again, the same as with natural grass.

An example of a hydrophilic additive that can be added to the infill is ethylene vinyl alcohol copolymer. This polymer is capable of absorbing a considerable amount of water, depending on the quantity of vinyl alcohol in the copolymer. Another example of a hydrophilic additive is polyhydroxyethyl methacrylate.

In another functional embodiment, the additive can be an oil-containing additive, in particular paraffin oil. In this way an artificial grass sports field is obtained which—provided with such an infill—offers less resistance upon interaction with play attributes and/or players, which on the one hand leads to improved playing characteristics and which on the other hand strongly decreases the risk of injury.

Furthermore, the additive can be an algicide. The use of such an additive not only prolongs the life of the artificial grass sports field, but it also leads to improved playing characteristics, since the quality of the artificial grass sports field can be guaranteed longer and, in addition, is more or less uniform over the entire field.

In a specific embodiment according to the invention, the granular infill is provided in a density of about 0.3-1.5 kg/dm$^3$. The density of the material preferably ranges from about 0.8 to about 1.49 kg/dm$^3$, for example, and more preferably from about 1.61 to about 2.5 kg/dm$^3$, and the granular infill has a diameter of less than about 1.5 mm.

Figure 1B:
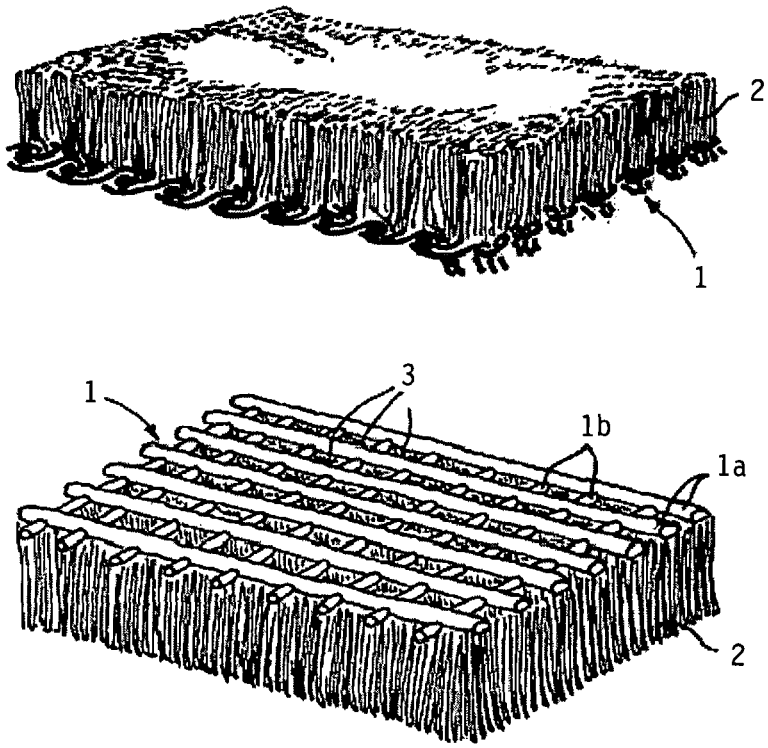

The invention will now be explained in more detail with reference to the drawings, in which:

FIGS. 1*a* and 1*b* schematically show a few embodiments of an artificial grass sports field provided with a granular infill according to the invention.

FIGS. 1*a* and 1*b* show a few embodiments of an artificial grass sports field in which a granular infill according to the invention can be used. In both Figures, the artificial grass sports field comprises a substrate 1, to which several synthetic fibers 2 have been attached at the locations indicated by reference numeral 3, for example, by tufting. The synthetic fiber can comprise any combination of materials and can be made of any synthetic material or mixture of synthetic materials. The synthetic fiber can be individually attached to the substrate or as a bundle of, for example, intertwined fibers 2*a*-2*c*. More in particular, the fiber that is used can be a fibrillated band fiber.

A granular infill 4 is provided between the synthetic fibers 2, which infill 4 is shown on a substantially enlarged scale (merely for illustrative purposes) in the form of spheres. Although such an artificial grass sports field provided with a granular infill 4 is known per se and is used in all kinds of different embodiments, additives that improve the playing characteristics of the artificial grass sports field have according to the invention been added to the granular infill 4.

In specific embodiments, one of the additives can be a flame retardant, in particular, aluminium trihydrate (ATH). On the other hand, in a functional embodiment, the additive can be an antistatic additive which is added to the granular infill during the production thereof.

Usually, the granular infill comprises a synthetic material, for example, a polyolefin-based material or vinyl polymer-based materials, which are also recyclable. The use of an antistatic additive in the granular infill provides that any static electricity generated during play can discharge. This prevents the granular infill from being statically charged during play, causing it to migrate upwards in the artificial grass sports field due to repulsion. This prevents the granular infill from being spread through the air during play. Furthermore, the antistatic additive ensures that any static charge that may be generated will be discharged via the artificial grass sports field rather than via the players.

The antistatic additive can be a polymer, in particular, a permanent antistatic agent, such as a polyamide or a polyester block amide. In another embodiment, on the other hand, the antistatic additive can be a polyester block copolymer, a glycerol ester, a synthetic amine or an alkyl sulphonate.

The additive that is added to the granular infill can be a hydrophilic additive, for example, ethylene vinyl alcohol copolymer. This polymer is capable of absorbing a significant amount of water, depending on the quantity of vinyl alcohol in the copolymer. Another example of a hydrophilic additive is polyhydroxyethyl methacrylate.

The artificial grass sports field thus obtained has this function-specific characteristic that it is capable of absorbing moisture (water) via the granular infill. As a result, the artificial grass sports field in question will remain moist longer, which has a positive effect on the way the players play (making sliding tackles, etc). When the field is played on, the absorbed moisture is released again, the same as with natural grass.

On the other hand, the additive can be an oil-containing additive, in particular, a paraffin oil. The artificial grass sports field—thus obtained—offers less resistance upon interaction between the players and the field, which, on the one hand, leads to improved playing characteristics and which, on the other hand, strongly decreases the risk of injuries (for example, when making a sliding tackle on the field).

Furthermore, an algicide can be used as the additive. This not only prolongs the life of the artificial grass sports field to a significant extent, since the field will no longer be affected by algal growth as a result of, for example, the weather conditions. Furthermore, the quality of the artificial grass sports field can be guaranteed longer, and a more or less uniform quality is obtained over the entire field.

The density of the granular infill can range from about 0.3-2.5 kg/dm$^3$. In a specific embodiment the granular infill is provided in a density of about 0.3-1.5 kg/dm$^3$. The density of the material preferably ranges from about 0.8 to about 1.49 kg/dm$^3$, for example, and more preferably from about 1.61 to about 2.5 kg/dm$^3$; and the granular infill 4 can have a diameter of less than about 1.5 mm.

In another embodiment, as shown in FIG. 1*b*, the synthetic fiber can be a monofilament. Also in this case, several monofilaments can be twined to form a bundle, after which each bundle is attached to the substrate 1. In FIG. 1*b*, the substrate has an open structure and comprises a grid of supporting yarns 1*a*-1*b*, to which the synthetic fibers 2 are attached.

The foregoing description and the accompanying drawings are illustrative of the present invention. Still other variations in arrangements of components are possible without departing from the spirit and scope of this invention.

The invention claimed is:

1. An artificial turf suitable for sports fields comprising a substrate to which a plurality of spaced-apart synthetic fiber tufts are attached and a granular infill disposed between the tufts, wherein the granular infill consists of a recyclable synthetic material and an additive therein selected from the group consisting of a hydrophilic polymer, an algicide, and mixtures thereof.

2. The artificial turf according to claim 1, wherein the additive is an algicide.

3. The artificial turf according to claim 1, wherein the granular infill has a density in the range of about 0.3-2.5 $kg/dm^3$.

4. The artificial turf according to claim 1, wherein the granular infill has a density in the range of about 0.3-1.5 $kg/dm^3$.

5. The artificial turf according to claim 1, wherein the granular infill has a density ranging from about 0.8 to about 1.49 $kg/dm^3$.

6. The artificial turf according to claim 1, wherein the granular infill has a density ranging from about 1.61 to about 2.5 $kg/dm^3$.

7. The artificial turf according to claim 1, wherein the granular infill has a diameter of less than about 1.5 mm.

8. An artificial turf suitable for sports fields comprising a substrate to which a plurality of spaced-apart synthetic fiber tufts are attached and a granular infill disposed between the tufts, wherein the granular infill consists of a recyclable synthetic material and a hydrophilic polymer additive.

9. The artificial turf according to claim 8, wherein the recyclable synthetic material further includes an algicide additive.

10. The artificial turf according to claim 8, wherein the hydrophilic additive is ethylene vinyl alcohol copolymer.

11. The artificial turf according to claim 8, wherein the hydrophilic additive is a polyhydroxyethyl methacrylate.

* * * * *